US007296580B1

(12) United States Patent
Sbardella

(10) Patent No.: US 7,296,580 B1
(45) Date of Patent: Nov. 20, 2007

(54) HAIR STYLING APPARATUS

(76) Inventor: Donna Sbardella, P.O. Box 118, Orwell, VT (US) 05760

( * ) Notice: Subject to any disclaimer, the term of this patent is extended or adjusted under 35 U.S.C. 154(b) by 93 days.

(21) Appl. No.: 11/225,633

(22) Filed: Sep. 12, 2005

(51) Int. Cl.
*A45D 24/10* (2006.01)

(52) U.S. Cl. ..... 132/122; 132/228; 132/237

(58) Field of Classification Search ..... 132/122, 132/118, 228, 237, 271, 272; 34/283, 96, 34/97, 98, 101; 15/145, 176.6, 176.1
See application file for complete search history.

(56) References Cited

U.S. PATENT DOCUMENTS

| | | | | | |
|---|---|---|---|---|---|
| 3,265,075 | A | * | 8/1966 | Edman et al. | 132/227 |
| 3,365,811 | A | | 1/1968 | Djenner | |
| 3,413,984 | A | * | 12/1968 | Tracy et al. | 132/238 |
| 3,599,345 | A | * | 8/1971 | Tolmie | 34/97 |
| 3,612,070 | A | | 10/1971 | Reyes | |
| 3,981,314 | A | * | 9/1976 | Barradas | 132/118 |
| 4,192,325 | A | * | 3/1980 | Liedtke | 132/271 |
| 4,222,398 | A | | 9/1980 | Fromman | |
| 4,267,851 | A | | 5/1981 | Plaisted | |
| 4,685,479 | A | | 8/1987 | McClean | |
| 5,220,931 | A | * | 6/1993 | Aida | 132/233 |
| 5,365,037 | A | | 11/1994 | Chan | |
| 5,513,665 | A | | 5/1996 | Chan | |
| 5,884,635 | A | | 3/1999 | O'Brien | |
| 5,887,600 | A | * | 3/1999 | Wilk | 132/262 |
| 6,029,307 | A | * | 2/2000 | Baudoin | 15/145 |
| 6,067,724 | A | * | 5/2000 | Depoyian | 34/97 |
| 6,502,585 | B1 | * | 1/2003 | Mazzei et al. | 132/237 |

FOREIGN PATENT DOCUMENTS

| | | |
|---|---|---|
| DE | 4.437.703 | 4/1996 |
| GB | 2.022.406 | 12/1979 |
| GB | 2.241.434 | 9/1991 |

* cited by examiner

*Primary Examiner*—Todd E. Manahan
(74) *Attorney, Agent, or Firm*—Michael I. Kroll

(57) ABSTRACT

Apparatus 10 discloses a plurality of hair curlers 40 having means for engaging a hair curling appliance comprising a handle assembly 12 having curler engaging and disengaging means, a circuit for producing a volume of heated air, control means for energizing and de-energizing the circuit, an actuator for engaging a temperature burst and means for tapping a power source. The housing incorporates a handle assembly 12 containing a heating element for electrically heating the air in use, an on/off switch 24, quick release ring 26 and temperature burst button 20. At one distal end of the curling wand 12 is a curler attachment port 30 that allows the user to insert a curler 14 and release the curler by a quick release ring 26. The assembly 12 allows for the use of a variety of different size and style curlers 14. A storage case 38 is provided.

13 Claims, 11 Drawing Sheets

HAIR STYLING APPARATUS

BACKGROUND OF THE INVENTION

1. Field of the Invention

The present invention relates generally to blow dryers and, more specifically, to a plurality of hair curlers having means for engaging a hair curling appliance comprising a housing having curler engaging and disengaging means, a circuit for producing a volume of heated air, control means for energizing and de-energizing said circuit, an actuator for engaging a temperature burst and means for tapping a power source. The housing incorporates a handle assembly containing a heating element for electrically heating the air in use, an on/off switch, quick release ring and temperature burst button. At one distal end of the curling wand is a curler attachment port that allows the user to insert a curler and release the curler by a quick release button. The wand allows for the use of a variety of different size and style curlers to be used. A storage case is provided.

2. Description of the Prior Art

There are other hair care device designed for styling. Typical of these is U.S. Pat. No. 3,365,811 issued to Djenner on Jan. 30, 1968.

Another patent was issued to Reyes on Oct. 12, 1071 as U.S. Pat. No. 3,612,070. Yet another U.S. Pat. No. 4,222,398 was issued to Fromman on Sep. 16, 1980 and still yet another was issued on U.S. Pat. No. 4,267,851 to Plaisted as U.S. Pat. No. 4,267,851.

Another patent was issued to McClean on Aug. 11, 1987 as U.S. Pat. No. 4,685,479. Yet another U.S. Pat. No. 5,365,037 was issued to Chan on Nov. 15, 1994. Another was issued to (Chan on (May 7, 1996 as U.S. Pat. No. 5,513,665 and still yet another was issued on Mar. 23, 1999 to O'Brien as U.S. Pat. No. 5,884,635.

Another patent was issued to Smal on Dec. 19, 1979 as U.K. Patent No. GB2022406. Yet another U.K. Patent No. GB2241434 was issued to Chan on Sep. 4, 1991. Another was issued to Assmann on Apr. 18, 1996 as German Patent No. DE4437703.

U.S. Pat. No. 3,365,811

Inventor: Richard Djenner

Issued: Jan. 30, 1968

A hair drier having a handle in which is placed an electrical resistance, comprising a rotor which is mounted and placed in such a way that implements placed upon the rotor can be turned independent of the position of the hand, said rotor or handle being provided with openings for a cold stream of air, said arrangement being such that a mantle of cold air is formed around the implement, e.g., a curler, said stream of air being provided from a blower which preferably is connected to the handle by means of a flexible tube.

U.S. Pat. No. 3,612,070

Inventor: Robert M. Reyes

Issued: Oct. 12, 1971

A power-driven hand-held hair curler having provision for selectively supporting both hot and cold types of curler rolls and operable to roll hair thereonto in either direction at the user's option. The accessory includes a support stand for the curler itself and provision for storing the curler rolls in readiness for use as well as a battery recharger.

U.S. Pat. No. 4,222,398

Inventor: Arthur R. A. Fromman

Issued: Sep. 16, 1980

An electrically powered device for curling hair including a power element containing handle housing portion and an angularly disposed, rotatable chucking device and spindle with a removable hair curler associated in driven relationship therewith. Make and break connections between the rotatable elements and the actuating means are made by the application of hand or finger pressure to the end of the curler, the end of the spindle or to conveniently located switches.

U.S. Pat. No. 4,267,851

Inventor: Richard E. Plaisted

Issued: May 19, 1981

A hair curling device including a heatable rod having a plurality of longitudinal channels. A non-conductive roller having a cage-like body is provided with a plurality of mating strips or bars. When the roller is slidably mounted on the rod, a sufficient heated surface area of the rod remains exposed for applying heat directly to a wound tress. The rod may be removed from the formed curl leaving the roller to support the hair while it cools to operate as a hair setter. If the rod remains mated to the roller and left in the hair while the hair cools, the device operates as a curling iron or styling wand.

U.S. Pat. No. 4,685,479

Inventor: John W. McClean

Issued: Aug. 11, 1987

A device for heating hair curling rollers consisting of an attachment for a hair dryer of the small portable type which is frictionally attached to the barrel of the hair dryer so that heated air from the dryer passes through the attachment. The attachment is arranged to support a number of hair curling rollers of a conventional type and to direct air from the hair dryer into and around the rollers to heat them to a working temperature. The usual heat indicating spot provided on each roller may be applied to the exterior of the attachment. As an adjunct to the attachment an adaptor is provided to enable the attachment to be attached to hair dryers having barrels of different external diameters. A fan is preferably included in the attachment to assist in even distribution of heated air over the hair curling rollers.

U.S. Pat. No. 5,365,037

Inventor: Wing K. Chan

Issued: Nov. 15, 1994

A hand-held electric curling iron has a hollow elongated barrel selectively insertable sequentially into one of a plurality of different diameter cylindrical hair rollers during the process of curling hair. The barrel communicates with an electric heater-blower assembly in the curling iron handle and has a plurality of apertures along its length for delivering a stream of heated air radially outwardly into the interior of the roller for heating the hair wound thereon. Each roller is provided at its ends with projecting collars for receiving and locating the barrel within the roller with a circumferential gap between the perforated portion of the roller and the barrel. The collars have circumferential apertures which cooperate with a retaining clip on the handle for securing the roller in place during use. While the external diameter of each roller is different for making different size curls, the collars of all the rollers have the same internal diameter so that the same curling iron can be used to heat the different diameter rollers.

U.S. Pat. No. 5,513,665

Inventor: Wing-kin Chan

Issued: May 7, 1996

Hair curling apparatus comprises a curling iron that can be inserted in a curling roller. The curling iron has a shaft for insertion in the roller formed by a number of elongate plate-like members, and the interior surface of the roller is formed with corresponding slots for receiving the edges of the plate-like members. Thus the curling iron may be easily located and secured within the roller. In another embodiment the curling iron is provided with a projection in an end face of the handle, the projection being received within a corresponding aperture formed in an end member of the roller.

U.S. Pat. No. 5,884,635

Inventor: Aideen Connolly O'Brien

Issued: Mar. 23, 1999

A hair styling device comprising a handle having a first curler interlocking element, a heatable curler having a second curler interlocking element, and a clamp attached to the handle and extending therefrom. The clamp is adapted to grasp hair between the clamp and the curler. The curler has a non-conductive upper rim with a cutaway portion. The clamp, the first interlocking element, and the second interlocking element are adapted to cooperatively secure the curler removably to the handle. Various embodiments for the interlocking elements are provided. The hair styling device may be part of a hair styling system further comprising a plurality of curlers and a heater for heating the curlers. There is also provided a method for curling hair with the hair styling system described.

U.K. Patent Number GB2022406

Inventor: Henri Smal

Issued: Dec. 19, 1979

An appliance having a supporting surface 2 and a handle 7 extending axially therefrom, the surface being capable of rotating about its axis in both directions. Means 8 are provided for engaging the supporting surface with the handle so that they rotate together, or disengaging the supporting surface from the handle so that it may rotate independently of the handle. The appliance may be particularly designed for care of the hair, the supporting surface being in the form of a brush. The coupling between the brush and handle facilitates winding the hair on to the brush and the rapid disengagement of the hair from the brush. The means 8 may comprise a ring which is axially slidable relative to the handle and which has slots 10 which cooperate with lugs 9 on the brush.

U.K. Patent Number GB2241434

Inventor: Wing Kin Chan

Issued: Sep. 4, 1991

A hair curling iron with a barrel (2) may be inserted into a curling drum (100), and a retaining clip (3) retains the barrel (2) in this position; the hair curling drum (100) can receive and locate the barrel (2) of a curling iron. Hair may be curled by putting the curling drums (100) in position in the hair, and then heating and reheating them as often as necessary using the hair curling iron. The advantage is a considerable saving in labour.

German Patent Number DE4437703

Inventor: Jurgen Assmann

Issued: Apr. 18, 1996

A notching device inside the hair roller (5) latches releasably and easily between the roller and the hair-drier adapter (2) in a spring design whose first notching element works with a rigid element fitted to the drier adapter. The roller preferably has two pairs of identically spaced opposing elements, notably a latching groove (12) on a spring leg (25) within the roller working with a nose (27) run right round the adapter. A releasable hair clip (20) grips part of the roller casing along its longitudinal axis by a spring clasp (29). The plug-in section (30) on the clip alongside the clasp plugs into the rear endface entry (21) of the drier facing away from this as against the entry (16) in the near endface which is turned towards the drier. A third notching element formed by a nose (31) round the clip plug-in section locks into the groove (32) in the roller to complete four-fold notching.

While these hair care devices may be suitable for the purposes for which they were designed, they would not be as suitable for the purposes of the present invention, as hereinafter described.

SUMMARY OF THE PRESENT INVENTION

The present invention discloses a plurality of hair curlers having means for engaging a hair curling appliance comprising a housing having curler engaging and disengaging means, a circuit for producing a volume of heated air, control means for energizing and de-energizing said circuit, an actuator for engaging a temperature burst and means for tapping a power source. The housing incorporates a handle assembly containing a heating element for electrically heating the air in use, an on/off switch, quick release ring and temperature burst button. At one distal end of the curling wand is a curler attachment port that allows the user to insert a curler and release the curler by a quick release ring. The wand allows for the use of a variety of different size and style curlers to be used. A storage case is provided.

A primary object of the present invention is to provide a hair care apparatus having means for attaching a hair roller thereto and means for releasing therefrom.

Another object of the present invention is to provide a hair care product wherein said hair care apparatus incorporates means for engaging and disengaging a heat source.

Yet another object of the present invention is to provide a hair care apparatus where preferably the housing is substantially cylindrical easily gripped and rotated by hand.

Still yet another object of the present invention is to provide a hair care product having a plurality of hair engaging elements, anchoring elements and blower/heater element having a carrying case for storage.

Additional objects of the present invention will appear as the description proceeds.

The present invention overcomes the shortcomings of the prior art by providing a plurality of hair curlers having means for engaging a hair curling appliance comprising a housing having curler engaging and disengaging means, a circuit for producing a volume of heated air, control means for energizing and de-energizing said circuit, an actuator for engaging a temperature burst and means for tapping a power source. The housing incorporates a handle assembly containing a heating element for electrically heating the curler in use, an on/off switch, quick release button and temperature burst button. At one distal end of the curling wand is a curler attachment port that allows the user to insert a curler and release the curler by a quick release button. The wand allows for the use of a variety of different size and style curlers to be used. A storage case is provided.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
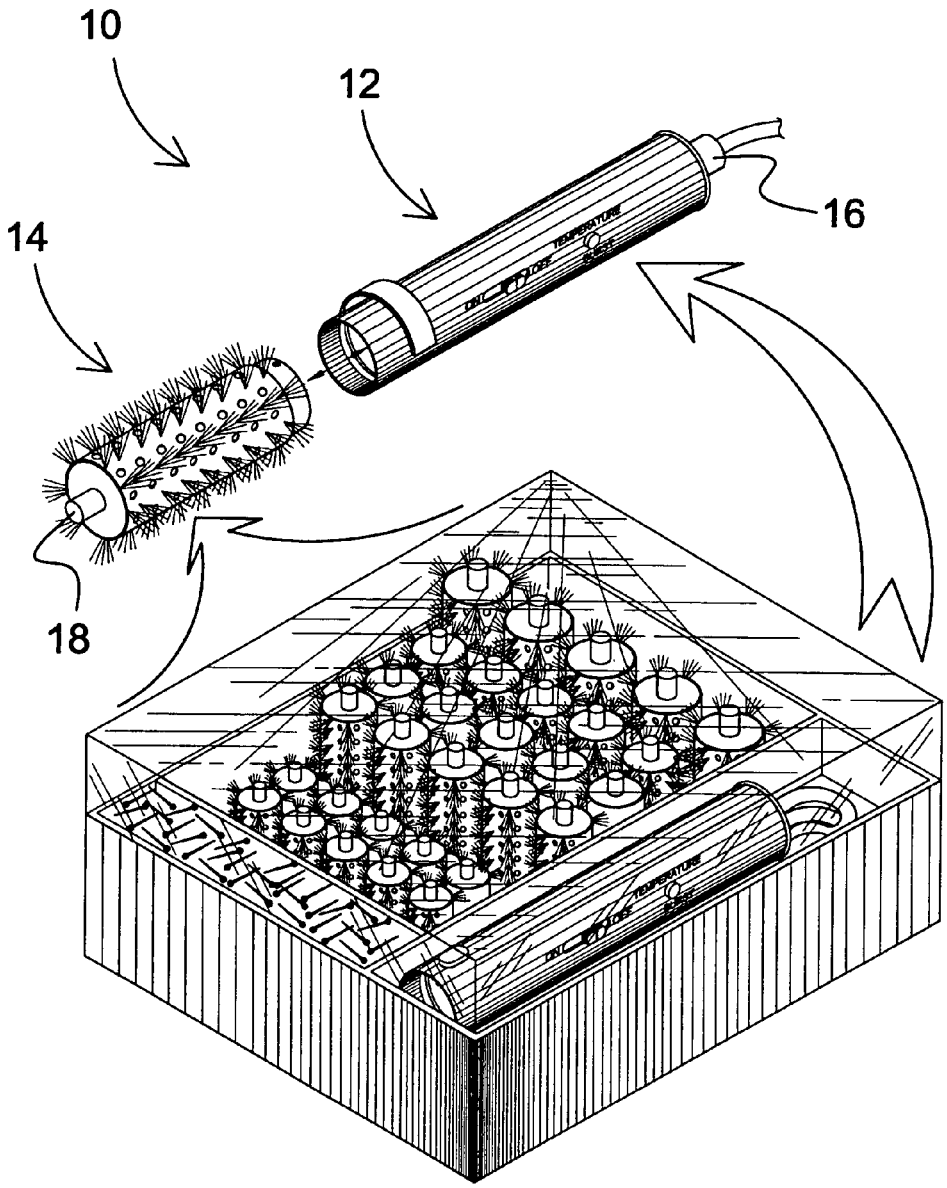
FIG. 1 is an illustrative view of the present invention in use.

With regard to reference numerals used, the following numbering is used throughout the drawings.

10 present invention
12 handle assembly
14 curler attachment
16 swivel
18 finger grip
20 burst button
22 cord
24 on/off switch
26 curler release ring
28 heated air
30 port
32 spring
34 locking member
36 finger pressure
38 storage case
40 curling brushes
42 holding pins
44 cover
46 cool tip
48 tip
50 groove

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a hair curling appliance comprising a handle assembly 12 incorporating an electric heating element and blower with means for fastening a user selected curler-type attachment 14 from a plurality of attachments to the handle assembly. The plurality of attachments having egress apertures placed to direct the flow of heated air therefrom. Integrated into the exterior housing is a switch for actuating the heater and blower with an additional spaced away actuator causing an increase in temperature while depressed. Also exteriorly accessible is one of a mating docking element whereby any one of a plurality of attachments 14 can be releasably fastened to the handle assembly 12 by means of the docking element engaging appropriately placed docking receptacles within each of the plurality of attachments. Also shown are swivel 16 and finger grip 18.

Figure 2:
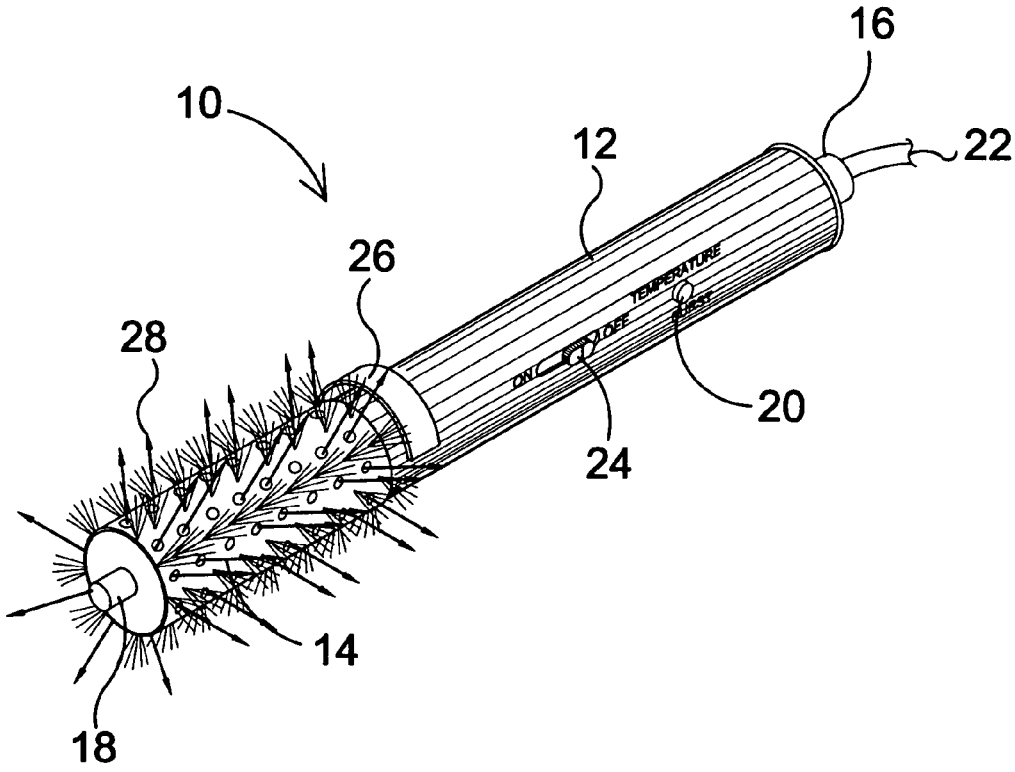
FIG. 2 is a perspective view of the present invention in use.

Turning to FIG. 2, shown therein is a perspective view of the present invention 10 in use. Shown is a perspective view of the present invention 10 disclosing a hair curling appliance comprising a blow dryer wand handle assembly 12 that can attach curling brushes of a curler attachment 14 to and release them with the use of one hand, a set of curling brushes consisting of varied lengths and diameters, a set of specially designed multi-pronged pins for holding curling brushes in hair and a storage case. Additionally shown is the present invention 10 having a burst button feature 20 to induce increased temperature to the heated air and air flow. The electric cord 22 is connected to the blow dryer wand 12 with a swivel mount 16. A finger grip 18 is disposed on the distal end of the attachment 14 for ease in handling the hot curler. Also shown are on/off switch 24, curler release ring 26 and heated air at 28.

Figure 3:
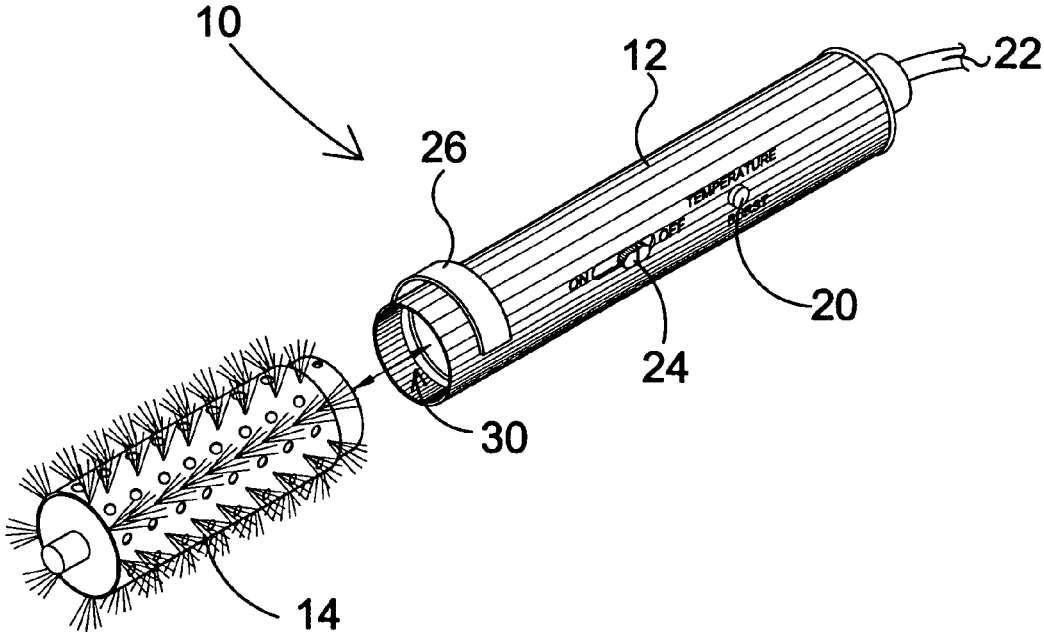
FIG. 3 is a perspective view of the present invention in use.

Turning to FIG. 3, shown therein is a perspective view of the present invention 10 in use. Shown is a perspective view of the present invention 10 disclosing a hair curling appliance comprising a handle assembly 12 including a heating element for electrically heating the curler 14 with heat flowing out of a plurality of holes while in use achieving the same results as a round brush and hairdryer, an on/off switch 24, quick release ring 26 and temperature burst button 20. At one distal end of the curling wand 12 is a curler attachment port 30 that allows the user to insert a curler 14 and release the curler by a quick release ring 26. The wand 12 allows for the use of a variety of different size and style curlers to be used. A storage case is provided. Also shown is cord 22.

Figure 4:
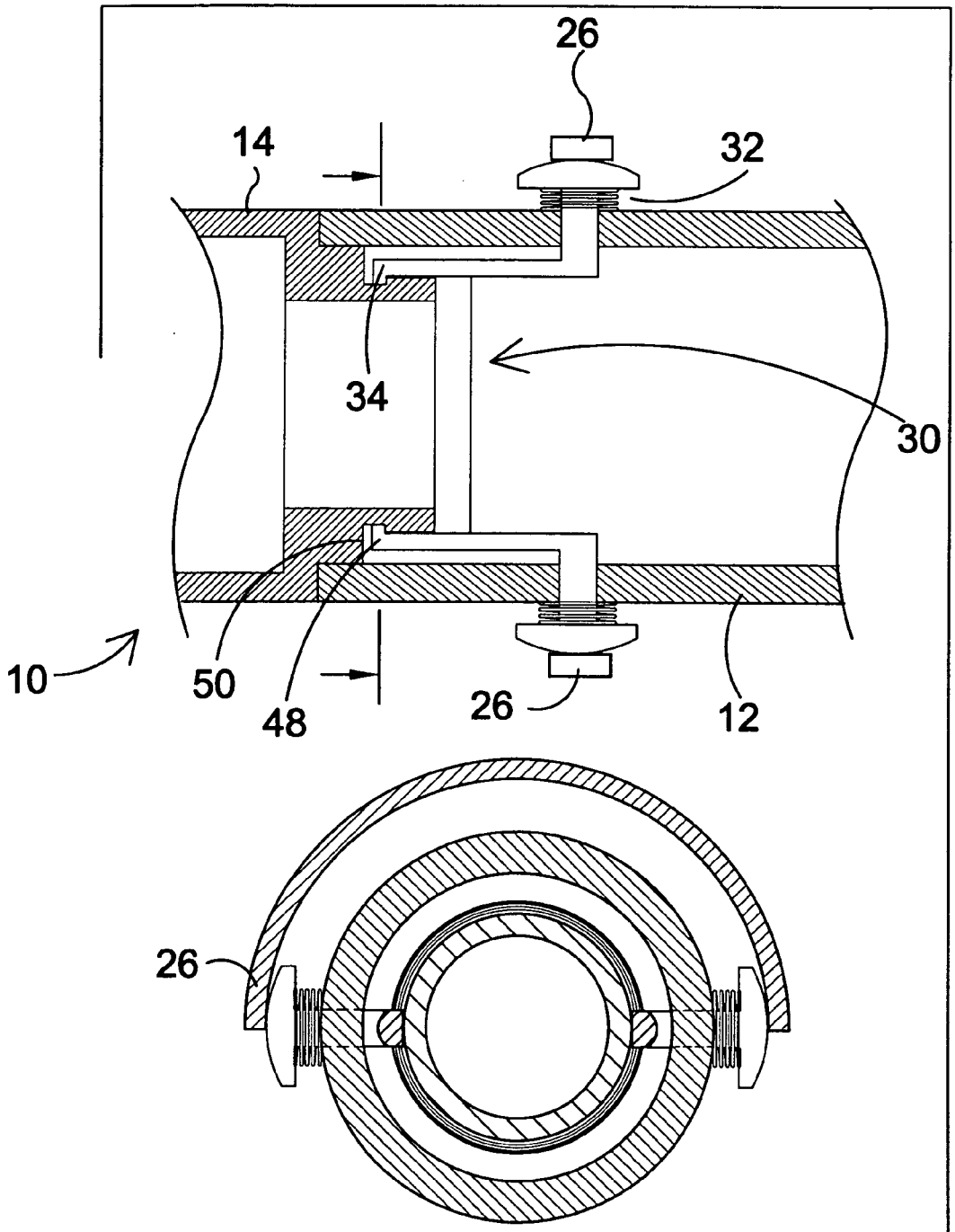
FIG. 4 is a sectional view of the present invention.

Turning to FIG. 4, shown therein is a sectional view of the present invention 10. Shown is a sectional view of the quick release mechanism of the present invention 10 in a lock in position. At one distal end of the curling wand 12 is a curler attachment port 30 that allows the user to insert a curler 14 and release the curler by a semi-circular quick release ring 26 with spring 32 and curler locking member 34. The wand 12 allows for the use of a variety of different size and style curlers 14 to be used. Also shown is the tip 48 locked in the groove 50.

Figure 5:
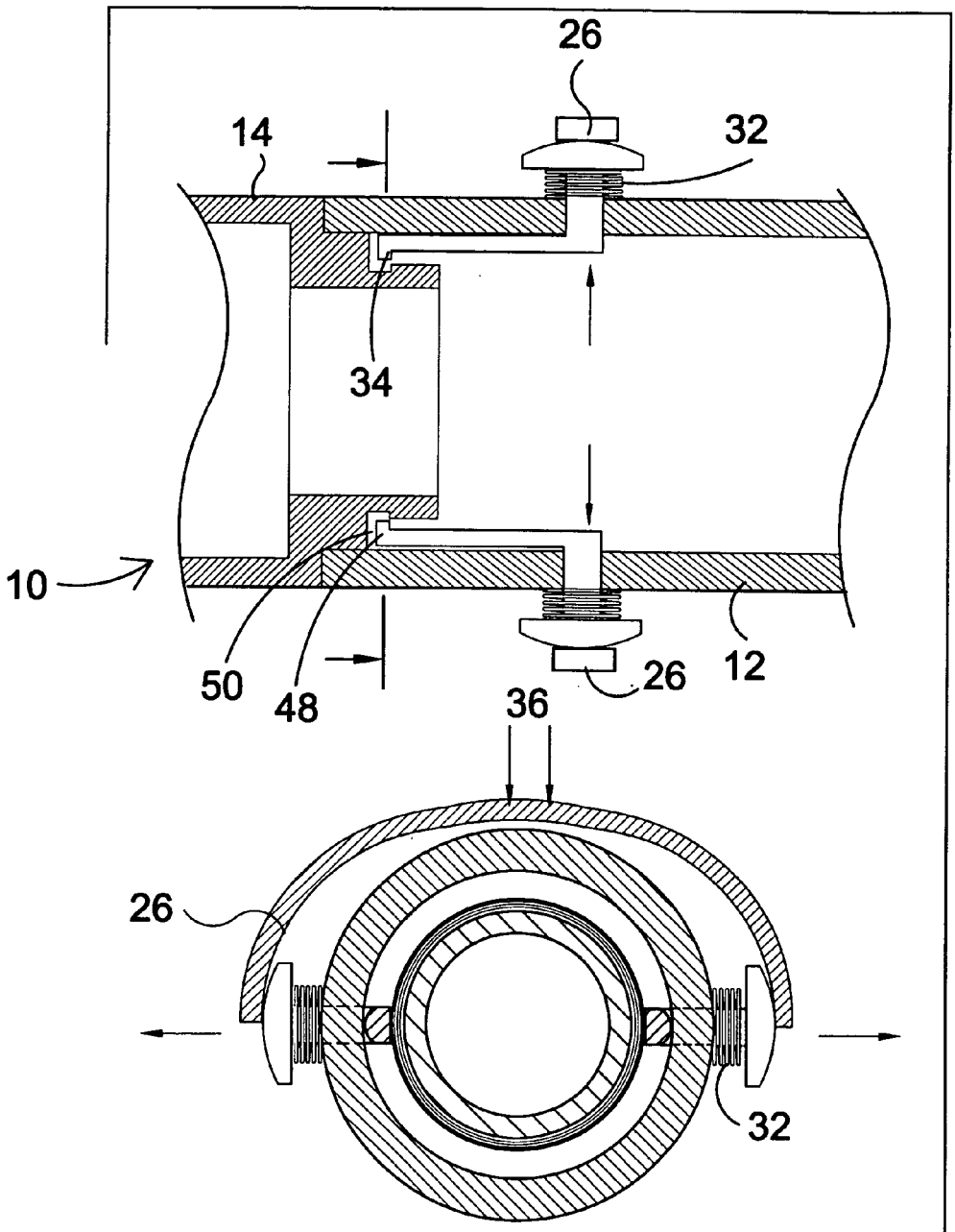
FIG. 5 is a sectional view of the present invention.

Turning to FIG. 5, shown therein is a sectional view of the present invention 10. Shown is a sectional view of the quick release mechanism of the present invention 10 in a curler release position. At one distal end of the curling wand 12 is a curler attachment port that allows the user to insert a curler 14 and release the curler by a quick release ring 26. The wand 12 allows for the use of a variety of different size and style curlers 14 to be used. Also shown are locking member 34, spring 32 and finger pressure at 36. Also shown is the tip 48 locked in the groove 50.

Figure 6:
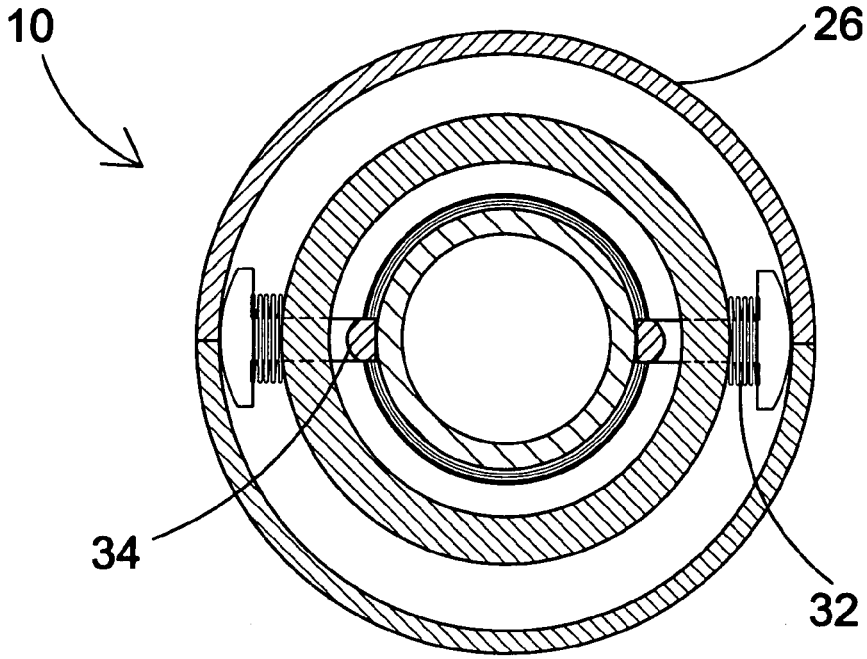
FIG. 6 is a sectional view of an alternate quick release mechanism of the present invention in a locked position.

Turning to FIG. 6, shown therein is a sectional view of an alternate quick release mechanism of the present invention 10 in a locked position. Shown is a sectional view of an alternate quick release mechanism of the present invention 10 in a lock in position. At one distal end of the curling wand is a curler attachment port that allows the user to insert a curler and release the curler by a circular quick release ring 26. The wand allows for the use of a variety of different size and style curlers to be used. Also shown are spring 32 and locking member 34.

Figure 7:
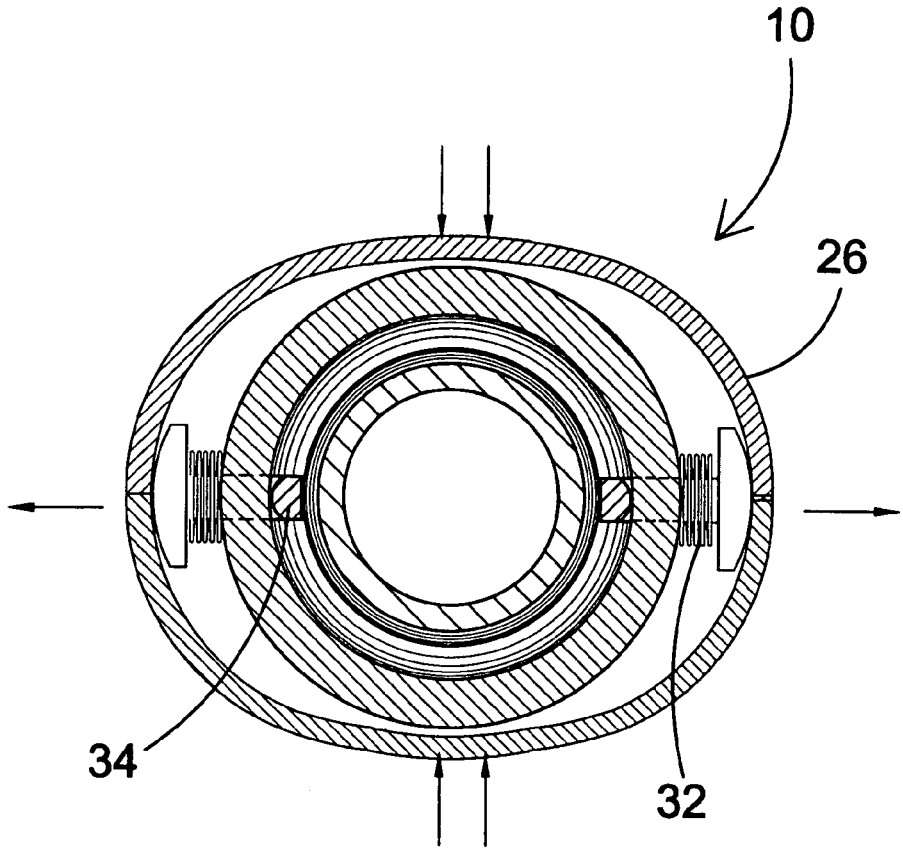
FIG. 7 is a sectional view of an alternate quick release mechanism of the present invention in an unlocked position.

Turning to FIG. 7, shown therein is a sectional view of an alternate quick release mechanism of the present invention 10 in an unlocked position. Shown is a sectional view of an alternate quick release mechanism of the present invention 10 in an unlocked position. At one distal end of the curling wand is a curler attachment port that allows the user to insert a curler and release the curler by a quick release ring 26. The wand allows for the use of a variety of different size and style curlers to be used. Also shown are spring 32 and locking member 34.

Figure 8:
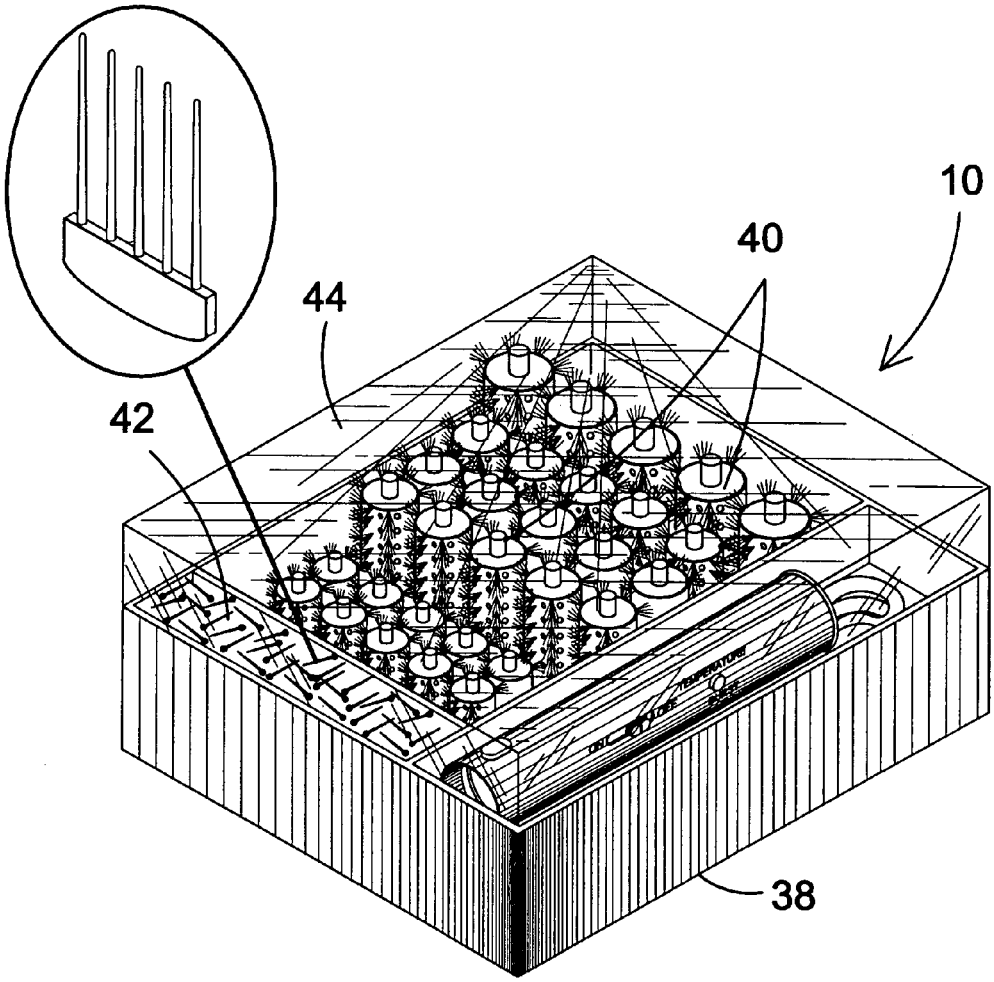
FIG. 8 is a perspective view of the storage case of the present invention.

Turning to FIG. 8, shown therein is a perspective view of the storage case of the present invention 10. Shown is a perspective view of the storage case 38 with cover 44 of the present invention 10 having a blow dryer wand that can attach curling brushes 40 to and release them with the use of one hand, and a set of plastic pic-type holding pins 42 for holding curling brushes in hair. Shown is a magnified view of a holding pin 42. The holding pins 42 may come in various sizes and shapes to further increase the versatility of the present invention 10.

Figure 9:
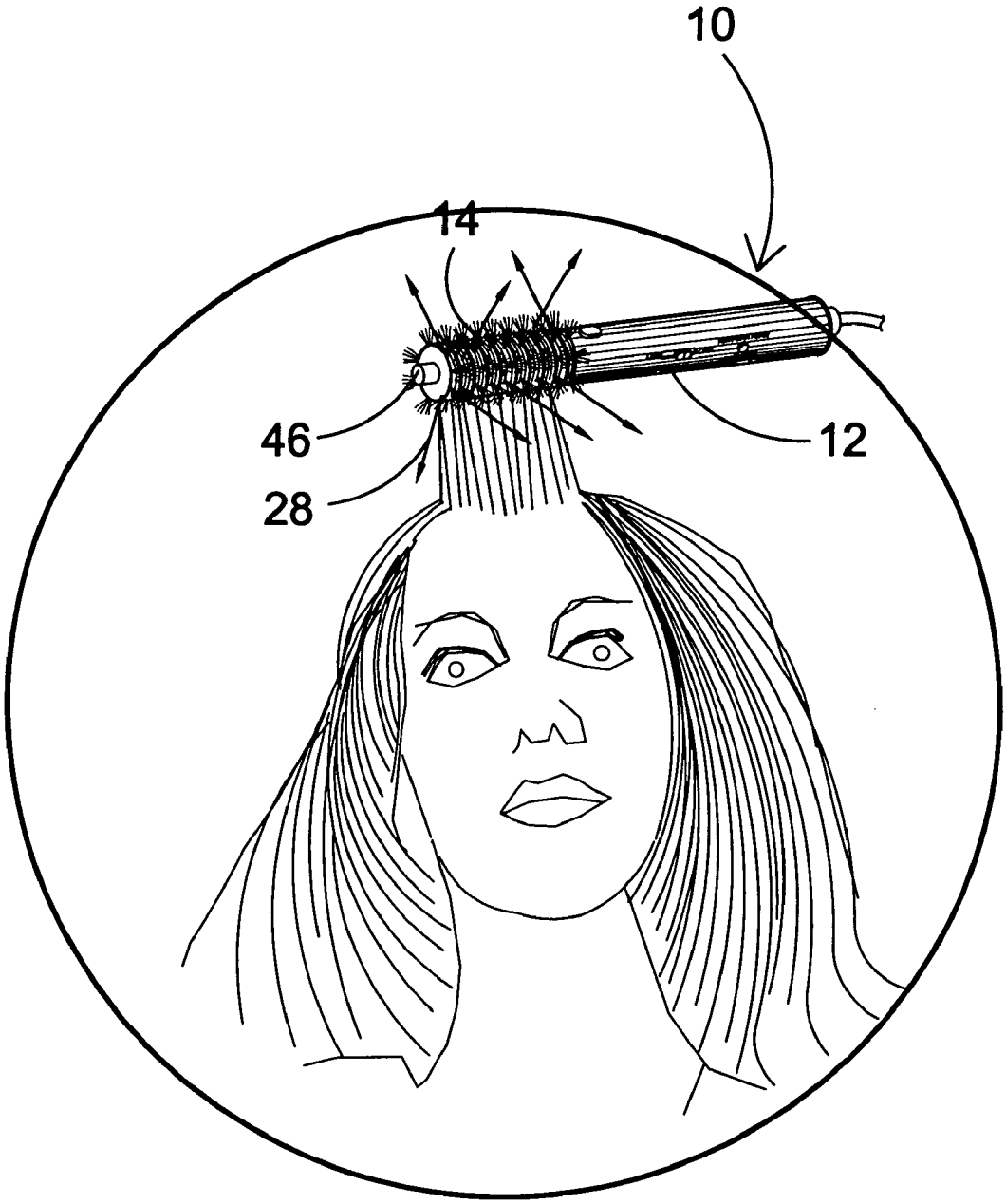
FIG. 9 is an illustrative view of the present invention in use.

Turning to FIG. 9, shown therein is an illustrative view of the present invention 10 in use. Shown is an illustrative view of the present invention 10 disclosing a hair curling appliance comprising a handle assembly 12 including a heating element for electrically heating the curler 14 in use with hot air 28, an on/off switch, quick release ring and temperature burst button. At one distal end of the curling wand 12 is a curler attachment port that allows the user to insert a curler 14 and release the curler by a quick release ring. The wand 12 allows for the use of a variety of different size and style curlers 14 to be used. A storage case is provided. Also shown is cool tip 46.

Figure 10:
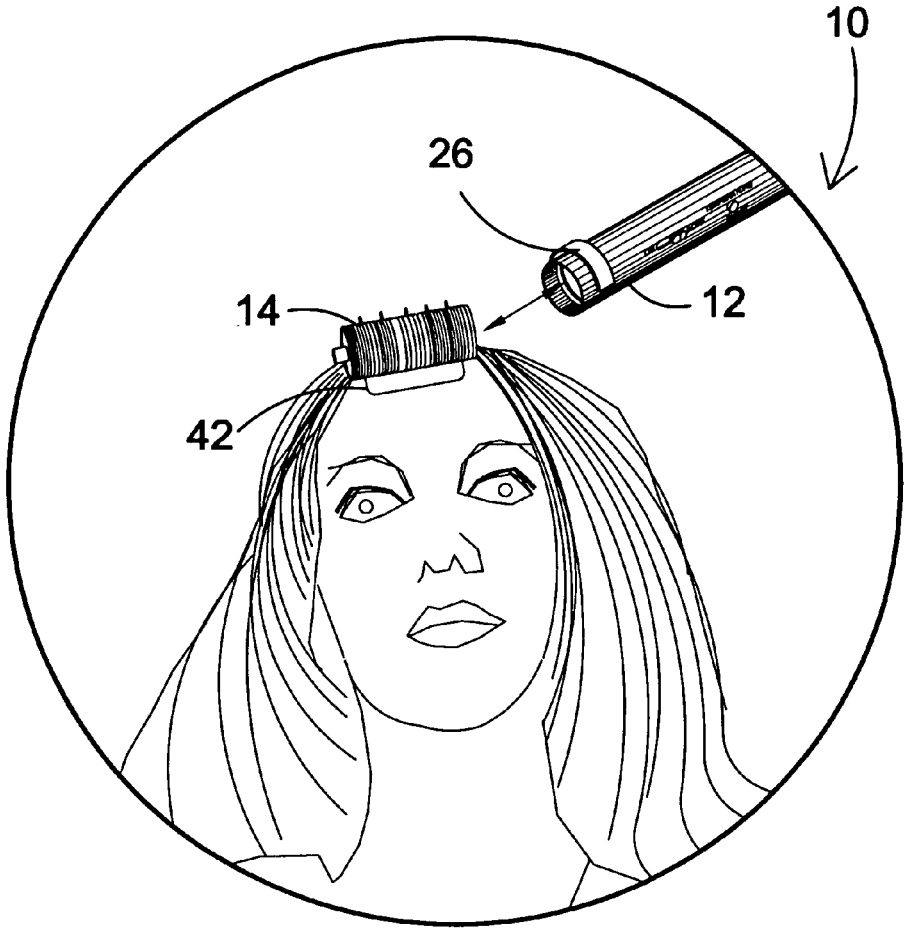
FIG. 10 is an illustrative view of the present invention in use.

Turning to FIG. 10, shown therein is an illustrative view of the present invention 10 in use. Shown is an illustrative view of the present invention 10 disclosing a hair curling appliance comprising a handle assembly 12 including a heating element for electrically heating the curler 14 with hot air in use, an on/off switch, quick release ring 26 and temperature burst button. At one distal end of the curling wand 12 is a curler attachment port that allows the user to insert a curler 14 and release the curler by a quick release ring 26. The wand 12 allows for the use of a variety of different size and style curlers 14 to be used. A storage case is provided. Also shown is holder pin 42.

Figure 11:
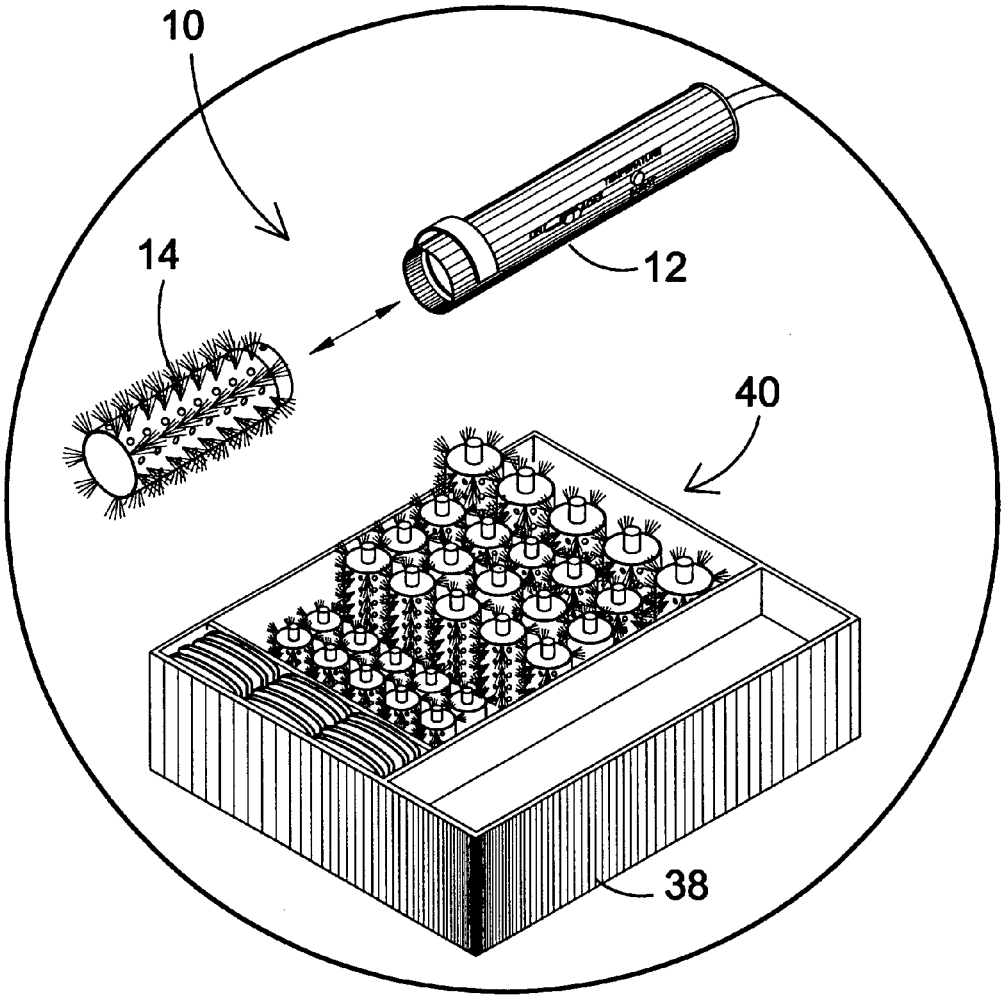
FIG. 11 is a detailed view of the present invention.

Turning to FIG. 11, shown therein is a detailed view of the present invention 10. Shown is a detailed view of the present invention 10 disclosing a hair curling appliance comprising a handle assembly 12 including a heating element for electrically heating the curler 14 with hot air in use, an on/off switch, quick release ring and temperature burst button. At one distal end of the curling wand 12 is a curler attachment port that allows the user to insert a curler 14 and release the curler by a quick release button. The wand 12 allows for the use of a variety of different size and style curlers 14 to be used. A storage box or case 38 is provided. Additionally shown is the present invention 10 providing a plurality of differently sized curlers 40 that may be presorted into sets, and sold specially suited for a consumer's differentiating length and type of hair.

I claim:

1. An apparatus for styling hair, the apparatus having an electrical circuit therein having components for producing a flow of heated air, comprising:

a) a handle assembly containing the electrical circuit, said handle assembly having first and second ends, said first end being open so that the heated air can flow out said open end;

b) a plurality of hair curlers having first and second ends, wherein each of said first ends is slidably mountable in said open end of said handle assembly so that the heated air is transmitted through said hair curler;

c) means for releasably attaching said hair curler to said handle assembly whereby the hair curler can be quickly and easily connected to and disconnected from the handle assembly;

d) wherein said plurality of hair curlers is provided in a plurality of sizes and curling styles; and e) wherein said means for releasably attaching said hair curler comprises:

i) a first and second curler locking member being disposed on opposite sides of said first end of said handle assembly for contacting and releasably securing said first end of said hair curler to said handle assembly;

ii) a curler release ring being disposed on said first end of said handle assembly so as to contact said first and second curler locking member, wherein said curler release ring is resilient; and iii) wherein finger pressure can be applied to the center of said curler release ring toward the central axis of said handle assembly to permit the hair curler to be released from the handle assembly.

2. The apparatus of claim 1, further comprising a box for storing said plurality of hair curlers, said box having a top thereon.

3. The apparatus of claim 1, wherein said hair curler and said handle assembly are cylindrical so that a user can easily grasp them.

4. The apparatus of claim 3, further comprising an electrical cord being disposed on said second end of said handle assembly, wherein said electrical cord is connected to said handle assembly with a swivel connection.

5. The apparatus of claim 4, further comprising a burst control being disposed on said handle assembly so that activation of said burst control provides a burst of heated air through said hair curler.

6. The apparatus of claim 5, further comprising an on/off switch being disposed on said handle assembly for controlling the electrical circuit.

7. The apparatus of claim 6, wherein each said hair curler has a plurality of holes therein, said holes being disposed in a uniformly spaced apart relationship between said first and second ends so that heated air is directed laterally circumferentially away from said hair curler to permit the hair of a user to be styled.

8. The apparatus of claim 7, said hair curlers each further comprising a curling brush being disposed about said hair curler.

9. The apparatus of claim 1, said first and second curler locking members each have a first and second ends, said first ends each having a head thereon being disposed on the outside of opposite sides of said handle assembly, said second ends each having a tip being disposed on the inside of opposite sides of said handle assembly to permit the tip to contact and releasably secure the first end of the hair curler to the handle assembly, a spring for biasing outwardly said heads, wherein said curler release ring contacts said head of each said first and second curler locking member so that said finger pressure can release the hair curler from the handle assembly.

10. The apparatus of claim 9, said hair curlers each having a groove on said first end, wherein said groove runs circumferentially around the hair curler for receiving said tip of said first and second curler locking member therein.

11. The apparatus of claim 10, wherein when said finger pressure is applied to the center of said curler release ring the ends thereof are deformed outward from said heads of said first and second locking members to permit said springs to move said heads outwardly so as to move said tips away from said grooves to permit the hair curler to be released from the handle assembly, and, when said finger pressure is released from the center of said curler release ring the ends thereof are deformed inward toward said heads of said first and second locking members to cause said heads to move inward and to cause said tips to move into said grooves to permit the hair curler to be attached to the handle assembly.

12. The apparatus of claim 11, wherein said curler release ring is semi-circular shaped.

13. The apparatus of claim 12, wherein said curler release ring is circular shaped.

* * * * *